US005380970A

United States Patent [19]

Mizuno et al.

[11] Patent Number: 5,380,970

[45] Date of Patent: Jan. 10, 1995

[54] PUSH BUTTON SWITCH

[75] Inventors: Yoshiyuki Mizuno; Kikuo Ogawa, both of Shizuoka, Japan

[73] Assignee: Yazaki Corporation, Japan

[21] Appl. No.: 32,635

[22] Filed: Mar. 17, 1993

[30] Foreign Application Priority Data

Mar. 18, 1992 [JP] Japan ..... 4-014652[U]

[51] Int. Cl.[6] ..... H01H 13/14

[52] U.S. Cl. ..... 200/523; 200/520; 200/524; 200/517

[58] Field of Search ..... 200/523, 520, 524, 512, 200/515, 517

[56] References Cited

U.S. PATENT DOCUMENTS 4,156,802 5/1979 Gilano et al. ..... 200/517
4,417,115 11/1983 Desmarais et al. ..... 200/524
4,559,426 12/1985 Van Zeeland et al. ..... 200/524

*Primary Examiner*—Henry J. Recla
*Assistant Examiner*—David J. Walczak
*Attorney, Agent, or Firm*—Wigman, Cohen, Leitner & Myers

[57] ABSTRACT

An ON/OFF push button switch is disclosed which includes a housing, a fixed contact fixedly mounted on the housing, and a movable contact adapted to be brought into and out of contact with the fixed contact. An operating portion of the disclosed switch is supported in the housing in which the movable contact is to be movable in a direction towards the fixed contact. A contact connect spring located between the housing and the movable contact is provided to urge the movable contact towards the fixed contact. A contact release spring is located between the housing and the operating portion to urge the operating portion away from the fixed contact with an urging force greater than that of the contact connect spring. A coupling arrangement is provided for releasably coupling the movable contact and the operating portion together with the movable contact being inhibited from being moved away from the operating portion towards the fixed contact. Operation control provision is made 1) for maintaining an ON state where the operating portion approaches the housing to put the movable contact in contact with the fixed contact and for 2) releasing the ON state when the operating portion is further pushed down towards the housing in the ON state.

7 Claims, 5 Drawing Sheets

PUSH BUTTON SWITCH

BACKGROUND OF THE INVENTION

This invention relates to a push button switch which is put into an ON state (or an OFF state) when an operating portion is pushed and then put into an OFF state (or an ON state) when the operating portion is pushed again.

A conventional push button switch of the type described is illustrated in FIGS. 1 and 2. A push button 1 is mounted on a housing 3 to be movable along an axial direction. The push button 1 is urged by a first spring 4 in an upward direction in FIGS. 1 and 2. The push button 1 has a guide chamber 5 which is formed at a position offset from a center axis of the push button 1. A movable contact 2 is mounted on a sleeve 6 which is movably inserted into the guide chamber 5. A second spring 7 is for urging the movable contact 2 towards a fixed contact 8 (in a downward direction in the figures).

The second spring 7 is substantially fully relaxed when the push button 1 is not pushed down, namely, in an OFF state. In this condition, an urging force for urging the movable contact 2 towards the fixed contact 8 is substantially equal to zero. The movable contact 2 is surrounded by a cylindrical rubber contact 9. The rubber contact 9 is for isolating the movable contact 2 from the fixed contact 8 when the urging force of the second spring 7 is equal to zero. The push button 1 is further provided with a heart cam (not shown). The housing 3 is provided with a pin 10 travelling along an outer periphery of the heart cam.

The heart cam comprises a cam plate having a recess formed on the upper side thereof. When the push button 1 is pushed down, the pin 10 is relatively upwardly moved along the outer periphery of the heart cam to be engaged with the recess of the heart cam. Thus, the push button 1 is held in a depressed position at a predetermined distance. When the push button 1 is pushed again, the pin 10 is released from engagement with the recess of the heart cam to thereby bring the push butt, on 1 into a free state.

In the push button switch of the above-mentioned structure, when the push button 1 is pushed in an OFF state, the first and the second springs 4 and 7 are compressed. The sleeve is moving downwardly by the urging force of the second spring 7. In this event, the rubber contact 9 is deformed to allow the movable contact 2 to be brought into contact with the fixed contact 8. On the other hand, the pin 10 is engaged with the recess of the heart cam to hold the push button 1 in the depressed position. Thus, the contacts are held in an ON state.

When the push button 1 is pushed again, the pin 10 is released from engagement with the recess of the heart cam after the first and the second springs 4 and 7 are slightly deformed. Subjected to the elastic restoring force of the first and the second springs 4 and 7, the push button 1 is moved upwardly. As a result, the second spring 7 is substantially fully relaxed and therefore loses the urging force for urging the movable contact 2 downwards. The movable contact 2 is moved away from the fixed contact 8 by the elastic restoring force of the rubber contact 9. Thus, the contacts are put into an OFF state.

In the above-mentioned push button switch, the push button 1 is pushed down to compress the second spring 7. The second spring 7 exerts the urging force to bring the movable contact 2 into contact with the fixed contact 8. In order to put the switch into an ON state, an operator must push down the push button 1 with a pressing force sufficient to compress the first and the second springs 4 and 7. Thus, the pressing force required to the operator inevitably becomes large.

SUMMARY OF THE INVENTION

It is an object of this invention to provide a push button switch which can reduce an operating force or a pressing force required to push a push button without decreasing a contact pressure between a fixed contact and a movable contact.

In order to accomplish the above-mentioned object, this invention provides a push button switch including a fixed contact fixedly mounted on a housing and a movable contact adapted to be brought into and out of contact with the fixed contact to thereby provide an ON state and an OFF state, comprising:

- an operating portion supported on the housing to be movable in a direction similar to a travelling direction of the movable contact;
- a contact connect spring located between the housing and the movable contact for urging the movable contact towards the fixed contact;
- a contact release spring located between the housing and the operating portion for urging the operating portion away from the fixed contact with an urging force greater than that of the contact connect spring;
- a coupling arrangement for coupling the movable contact and the operating portion with the movable contact inhibited from being moved away from the operating portion towards the fixed contact; and
- operation control means for maintaining the ON state where the operating portion approaches the housing to put the movable contact in contact with the fixed contact and for releasing maintenance of the ON state when the operating portion is further pushed towards the housing in the ON state.

In the push button switch of the above-mentioned structure, when the operating portion is pushed down towards the housing in an OFF state, the operating portion is moved towards the fixed contact against the urging force of the contact release spring. Since the movable contact is coupled through the coupling arrangement to the operating portion, the movable contact is allowed to move towards the fixed contact by a distance corresponding to the movement of the operating portion towards the fixed contact. Accordingly, the movable contact is moved towards the fixed contact by the urging force of the contact connect spring. The movable contact is further pushed by the urging force of the contact connect spring and finally brought into contact with the fixed contact to provide an ON state. The ON state is maintained by the operation control means.

When the operating portion is again pushed down towards the housing, the operating portion is moved towards the fixed contact against the urging force of the contact connect spring. Simultaneously, the operation control means releases maintenance of the ON state. Accordingly, the operating portion is turned into a free state and returned to its initial position by the urging force of the contact release spring. Since the contact release spring urging force is greater than that of the contact connect spring and the coupling arrangement inhibits the movable contact from being moved away from the operating portion, the movable contact is returned to its initial position together with the operating portion. Thus, the contacts are put into an OFF state.

According to this invention, the urging forces of the contact release spring and the contact connect spring act in opposite directions to cancel each other. Accordingly, the push button can be operated with a small pressing force.

DESCRIPTION OF THE PREFERRED EMBODIMENTS

Now, description will be made as regards an embodiment of this invention with reference to FIGS. 3 through 9.

Figure 1:
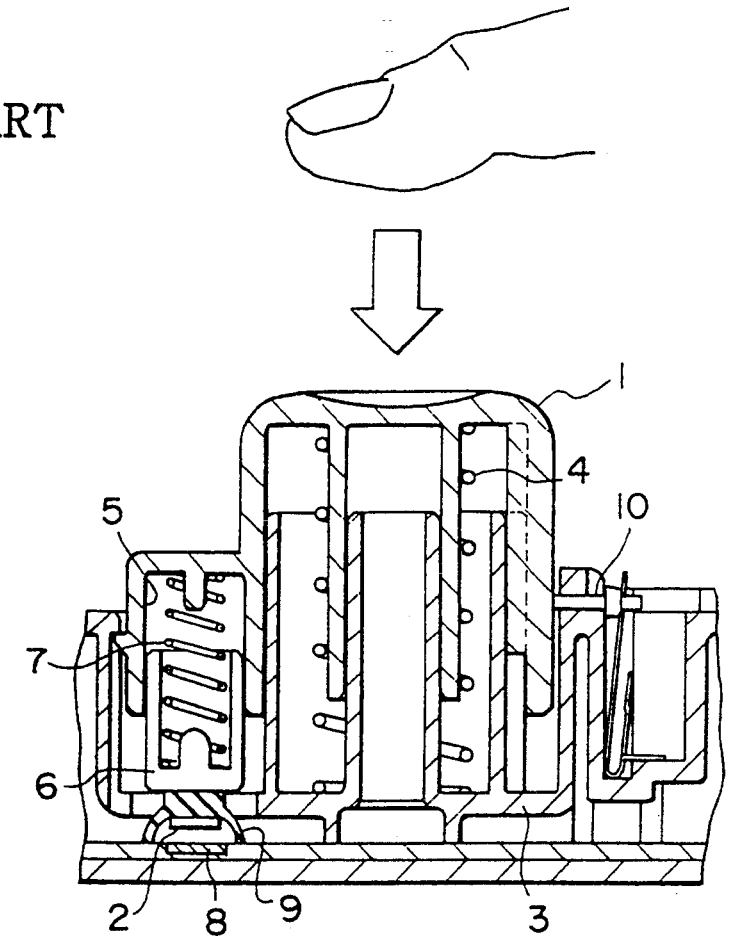
FIG.1 PRIOR ART
FIG. 1 is a sectional view of a conventional push button switch in an OFF state.
Figure 2:
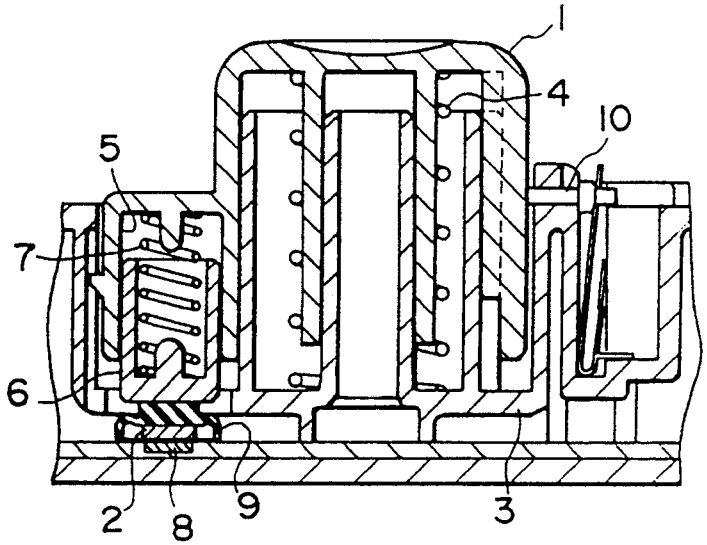
FIG.2 PRIOR ART
FIG. 2 is a sectional view of the conventional push button switch illustrated in FIG. 1 in an ON state.
Figure 3:
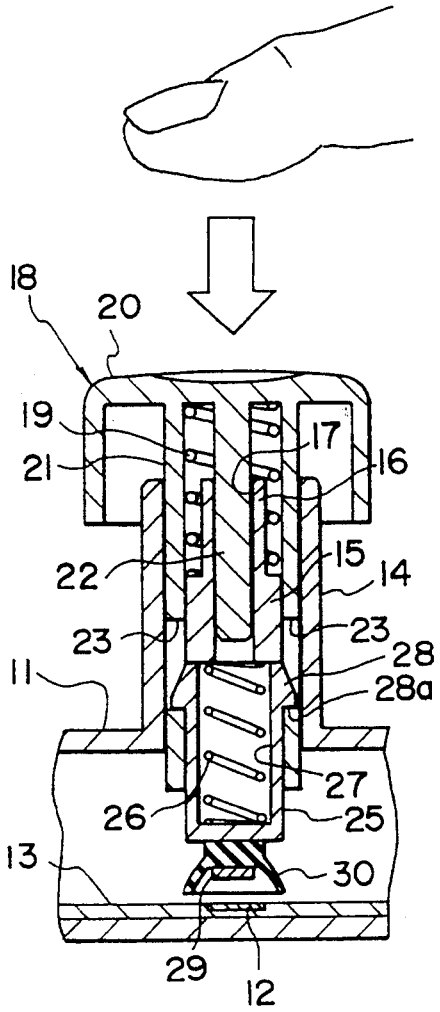
FIG. 3 is a sectional view of a push button switch according to an embodiment of this invention in an OFF state.
Figure 4:
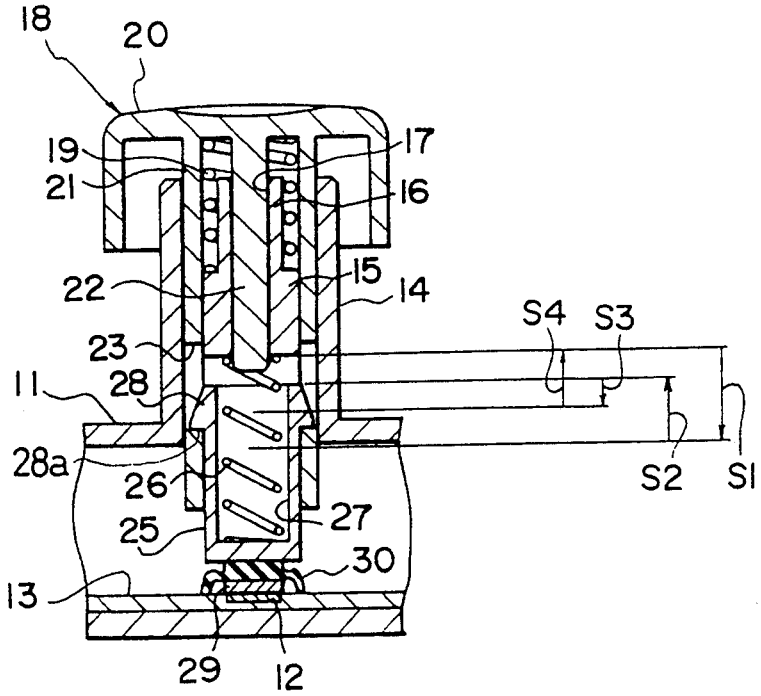
FIG. 4 is a sectional view of the push button switch illustrated in FIG. 3 in an ON state.
Figure 5:
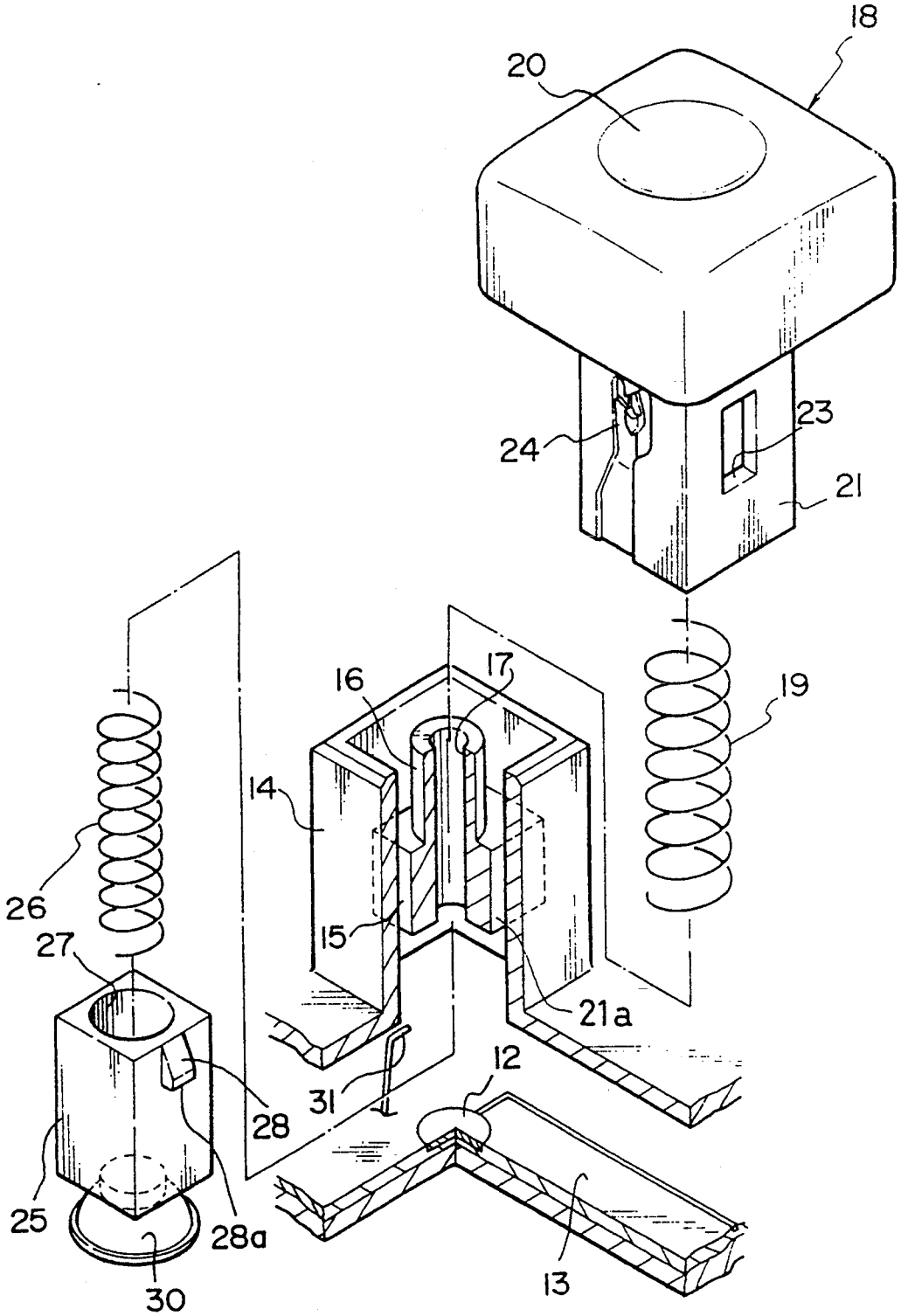
FIG. 5 is an exploded perspective view of the push button switch illustrated in FIGS. 3 and 4.
Figure 6:
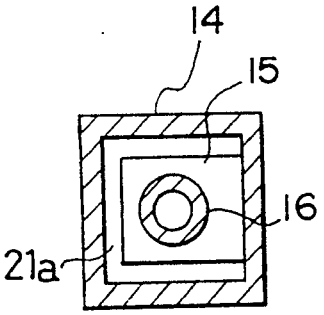
FIG. 6 is a sectional view of a guide chamber of the push button switch illustrated in FIG. 3.

Referring to FIGS. 3 and 4, a push button switch according to this invention comprises a housing 11 which accommodates a circuit board 13 including a fixed contact 12. The housing 11 is provided with a guide chamber 14 having a rectangular section and extending upwardly of the figure (away from the fixed contact 12), as shown in FIGS. 5 and 6. The guide chamber 14 has a rectangular column member 15 mounted on one inner surface thereof. A cylindrical member 16 is coaxially formed on the rectangular column member 15. A through hole 17 having a circular section is formed through the rectangular column member 15 and the cylindrical member 16 to be coaxially aligned with the guide chamber 14.

Figure 7:
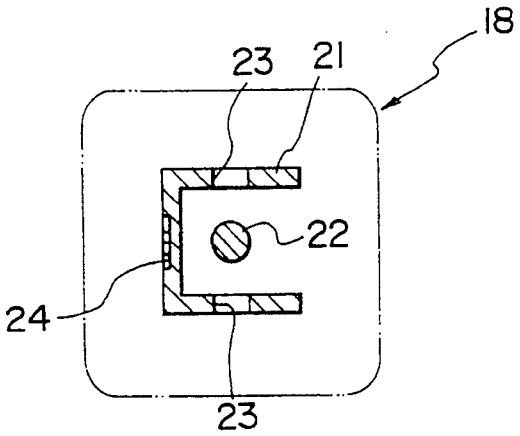
FIG. 7 is a sectional view of a push button of the push button switch illustrated in FIG. 3.
Figure 8:
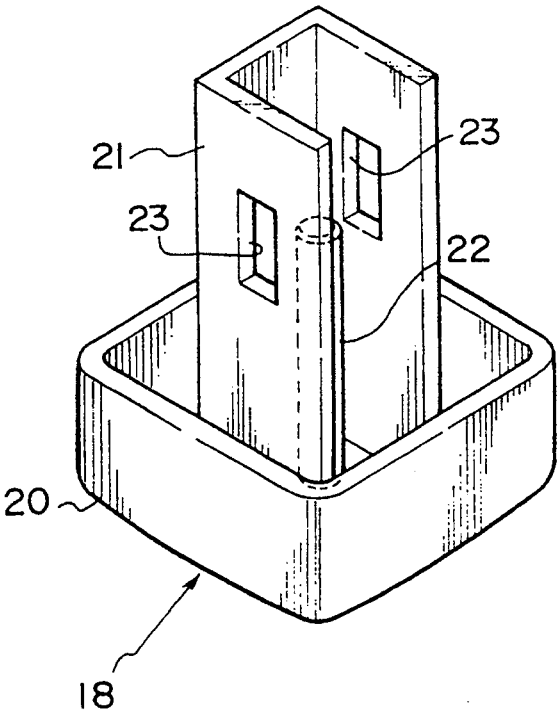
FIG. 8 is a perspective view of the push button of the push button switch illustrated in FIG. 3.

The guide chamber 14 accommodates a push button (operating portion) 18 together with a contact release coil spring (contact release spring) 19. The push button 18 comprises a button member 20 to be pushed by an operator, a guide wall member 21, and a guide cylinder member 22. As shown in FIGS. 7 and 8, the guide wall member 21 has a U-shaped section so that the guide wall member 21 is inserted between the inner surface of the guide chamber 14 and the outer surface of the rectangular column member 15. The guide wall member 21 is greater in length than the guide chamber 14. A slide groove 21*a* having a U-shaped section is defined between the inner surface of the guide chamber 14 and the outer surface of the rectangular column member 15.

A pair of vertically elongated guide apertures 23 are formed at corresponding opposite positions on two opposite walls of the guide wall member 21. One of the remaining walls of the guide wall member 21 is provided with a cam groove 24 (FIG. 9) formed on its outer peripheral surface. The guide cylinder member 22 is axially movably fitted into the through hole 17 when the guide wall member 21 is inserted into the guide chamber 14.

The contact release coil spring 19 is fitted on the outer periphery of the cylindrical member 16. The contact release coil spring 19 has one end adjacent to the upper surface of the rectangular column member 15 and the other end adjacent to the inner surface of the button member 20 of the push button 18. The contact release coil spring 19 is for urging the push button 18 upwardly (in the figure) with a predetermined urging force, with the push button 18 prevented by it sleeve 25 (which will presently be described) from being removed from the guide chamber 14.

The sleeve 25 is in the form of a rectangular column so as to be inserted into the guide wall member 21. The sleeve 25 has, along its center axis, a hole 27 having a circular section and a closed bottom for holding a contact connect coil spring (contact connect spring) 26. The sleeve 25 is provided with a pair of projections 28 formed at corresponding opposite positions on two opposite outer side surfaces thereof. The projections 28 are fitted into the guide apertures 23 of the guide wall member 21 to be movable within the guide apertures 23 along a vertical direction. Each of the projections 28 has a notch 28*a* which is brought into contact with the lower edge of the guide aperture 23 to prevent the sleeve 25 from being downwardly moved out of the guide wall member 21. A combination of the guide apertures 23 and the projections 28 serves as a coupling arrangement for inhibiting the sleeve 25 from being moved away from the push button 18 towards the fixed contact 12.

The contact connect coil spring 26 is assembled between the bottom of the hole 27 and the lower surface of the rectangular column member 15 in a compressed state at a predetermined degree of compression. The contact connect coil spring 26 is coaxially aligned with the contact release coil spring 19. Thus, the contact connect coil spring 26 and the contact release coil spring 19 are arranged in cascade. The urging forces of the contact release coil spring 19 and the contact connect coil spring 26 act in opposite directions to cancel each other. The urging force of the contact connect coil spring 26 in the compressed state is selected to be smaller than the urging force of the contact release coil spring 19 when the push button 18 is located in an upper position and the upper end of the sleeve 25 is brought into contact with the lower surface of the rectangular column member 15.

The sleeve 25 has a movable contact 29 on the lower surface thereof. The movable contact 29 is faced to the fixed contact 12. The movable contact 29 is surrounded by a rubber skirt contact 30 having a lower end positioned below the movable contact 29. The rubber contact 30 is made of an elastic material having a sufficient flexibility so that the rubber contact skirt 30 is deformed by the urging force of the contact connect coil spring 26 to allow the movable contact 29 to be brought into contact with the fixed contact 12.

As illustrated in FIG. 5, the housing 11 is provided with a pin 31. A combination of the pin 31 and the cam groove 24 forms an operation control arrangement. The pin 31 is engaged with the cam groove 24. The pin 31 is formed by perpendicularly bending the end portion of a torsion coil spring towards the bottom of the cam groove 24. The pin 31 has a top end which is urged towards the bottom of the cam groove 24 and towards a first reference side surface 32*a* of the cam groove 24.

Description will now be made as regards an operation of the pin 31 and a structure of the cam groove 24.

Figure 9:
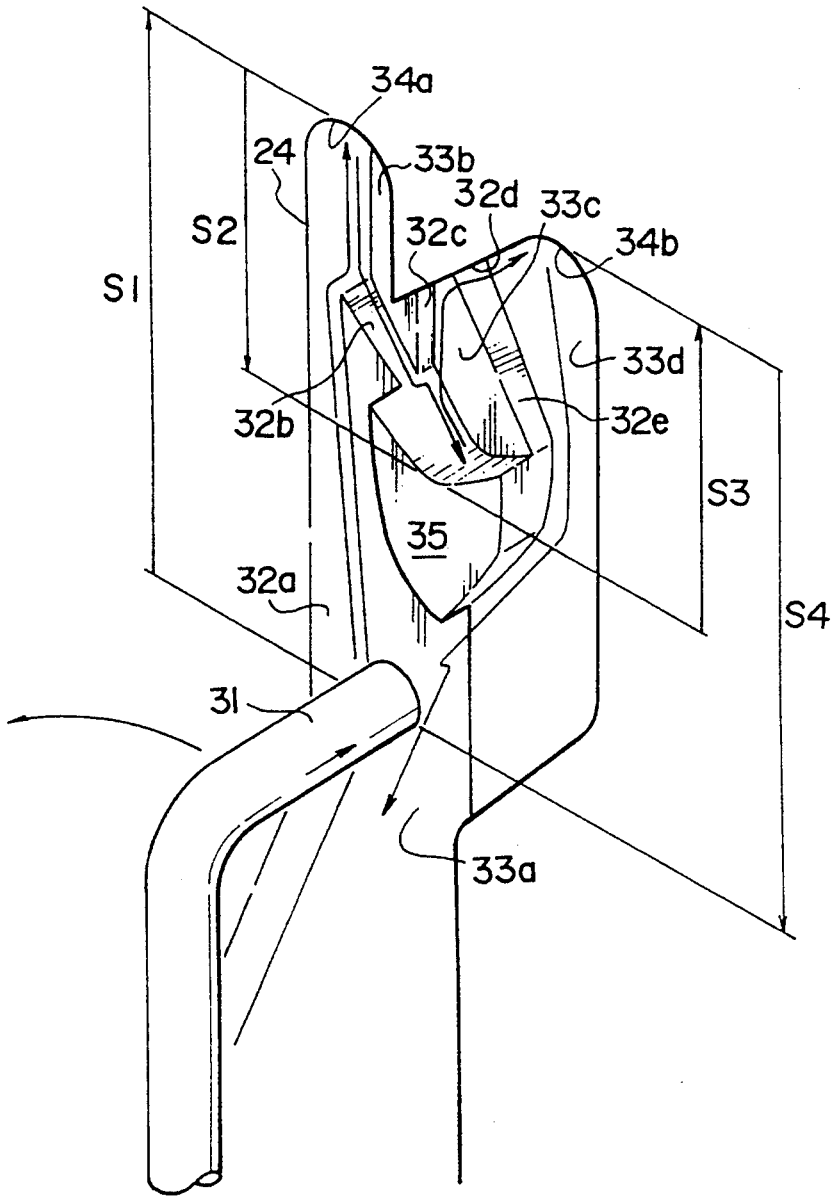
FIG. 9 is a perspective view of a cam groove formed in the push button switch illustrated in FIG. 3.

As illustrated in FIG. 9, the cam groove 24 has a first bottom surface 33*a* which is in contact with the end face of the pin 31 when the push button 18 is located at an uppermost position, namely, when the contacts are kept in an OFF state. When the push button 18 is pushed in the OFF state, the pin 31 is relatively upwardly moved along the first reference side surface 32*a*. After movement of a stroke S1, the pin 31 reaches a first upper limit side surface 34*a*. The first upper limit side surface 34*a* is contiguous to the first reference side surface 32*a* and has a concave shape. At this time, the end face of the pin 31 is brought into contact with a second bottom surface 33*b* formed at a depth deeper than that of the first bottom surface 33*a*.

When the push button 18 is then released from the pressing force, the pin 31 is relatively downwardly moved along the first reference side surface 32*a*. Subsequently, the pin 31 is obliquely moved down to a center portion of the cam groove 24 along a second reference side surface 32*b* formed at a step portion between the first bottom surface 33*a* and the second bottom surface 33*b*. After movement of a stroke S2, the pin 31 is engaged with an engaging portion 35 of a concave shape formed at a lowermost position of the second reference side surface 32*b* and is stopped. At this time, the end face off the pin 31 is brought into contact with a third bottom surface 33*c* formed at a depth deeper than that of the second bottom surface 33*b*.

Engaged with the engaging portion 35, the pin 31 is stably held. Thus, the push button 18 is stably maintained in a depressed position at a predetermined distance (e.g., the distance between S1 and S2) [(=S1−S2)]. In this event, the sleeve 25 is allowed to be downwardly moved by a distance corresponding to the predetermined distance of depression of the push button 18. Accordingly, the sleeve 25 is downwardly moved by the urging force of the contact connect coil spring 26. By the urging force of the coil spring 26, the rubber contact skirt 30 is brought into contact with the circuit board 13 and deformed. As a result, the movable contact 29 is brought into contact with the fixed contact 12. Thus, the contacts are put into an ON state.

When the push button 18 is again pushed in the ON state, the pin 31 is moved relatively upward. At first, the pin 31 is moved upwardly along a third reference side surface 32*c* formed at a step portion between the second bottom surface 33*b* and the third bottom surface 33*c*. Subsequently, the pin 31 is obliquely moved upwardly along a fourth reference side surface 32*d* contiguous to the third reference side surface 32*c* and having an upward slope. After movement of a stroke S3, the pin 31 reaches a second upper limit side surface 34*b* and is stopped. At this time, the end face of the pin 31 is brought into contact with a fourth bottom surface 31*d* formed at a depth deeper than that of the third bottom surface 33*c*.

When the push button 18 is released from the pressing force after the pin 31 reaches the second upper limit side surface 34*b*, the pin 31 is downwardly moved along a fifth reference side surface 32*e* formed at a step portion between the third bottom surface 33*c* and the fourth bottom surface 33*d*. After movement of a stroke S4, the upper surface of the sleeve 25 is brought into contact with the lower surface of the rectangular column member 15 and the relative movement of the pin 31 is stopped. In this event, the end face of the pin 31 is moved from the fourth bottom surface 33*d* to the first bottom surface 33*a*. The fourth bottom surface 33*d* has a variable depth which is gradually decreased along a downward direction from the uppermost position adjacent to the second upper limit side surface 34*b* to the lowermost position where the fourth bottom surface 33*d* is smoothly connected to the first bottom surface 33*a*.

The part including the engaging portion 35 forms a heart cam with a recess defined by the engaging portion 35. The strokes S1, S2, S3, and S4 depicted by arrows in FIG. 4 and in FIG. 9 represent the movement of the push button 18 and the relative movement of the pin 31 with respect to the cam groove 24, respectively.

In the push button switch of the above-mentioned structure, when the push button 18 is pushed down in an OFF state, the push button 18 is moved and stopped after movement of the stroke S1. When the pressing force is released at this stage, the push button 18 is returned to the initial position after movement of the stroke S2 and is stopped at that position.

In this condition, the sleeve 25 is given a sufficient stroke to bring the movable contact 29 into contact with the fixed contact 12. The sleeve 25 is downwardly moved by the urging force of the contact connect coil spring 26. By the urging force of the contact connect coil spring 26, the rubber contact skirt 30 is brought into contact with the circuit; board 13 and is deformed. As a result, the movable contact 29 is brought into contact with the fixed contact 12. Thus, the contacts are brought together into an ON state.

When the push button 18 is again pushed in the ON state, the push button 18 is moved and stopped after movement of the stroke S3. When the pressing force is released at this stage, the push button 18 is moved by the stroke S4 to be returned to the initial position in the OFF state. In this event, the sleeve 25 is upwardly lifted through the guide apertures 23 and the projections 28. Accordingly, the movable contact 29 is moved away from the fixed contact 12 to put the contacts into the OFF state.

In the push button switch of the above-mentioned structure, the urging forces of the contact release coil spring 19 and the contact connect coil spring 26 act in opposite directions to cancel each other. As a result, the push button 18 can be operated with a small pressing force. In addition, the push button switch can be mounted in a narrow space which is small in area. Since the push button 18 and the movable contact 29 are coaxially aligned, the push button 18 and the sleeve 25 are smoothly moved along the axial direction. It is therefore possible to prevent occurrence of a contact failure.

What is claimed is:

1. A push button switch having an ON state and an OFF state, comprising:

a housing;

a fixed contact fixedly mounted on said housing:

a movable contact movable along a path into and out of contact with said fixed contact to provide said ON state and said OFF state;

an operating portion supported on said housing to be movable in a direction parallel to said movable contact path;

a contact connect spring located between said housing and said movable contact for urging said movable contact towards said fixed contact;

a contact release spring located between said housing and said operating portion for urging said housing and said operating portion for urging said operating portion away from said fixed contact with an urging force greater than that of said contact connect spring;

a coupling arrangement for coupling said movable contact and said operating portion with said movable contact inhibited from being moved away from said operating portion towards said fixed contact; and operation control means for maintaining said ON State wherein said operating portion approaches said housing to bring said movable contact into contact with said fixed contact and for releasing maintenance of said ON state when said operating portion is further pushed towards said housing in said ON state, wherein said coupling arrangement comprises an engagement aperture formed in said guide wall member, and a sleeve engaged with said engagement aperture in said guide wall member and urged by said contact connect spring towards said fixed contact, said movable contact being fixedly mounted on said sleeve to face said fixed contact.

2. A push button switch having an ON state and an OFF state, comprising:

a housing having a guide chamber, a column member formed in said guide chamber, and a slide groove defined between an outer periphery of said column member and an inner wall of said guide chamber;

an operating portion having a push button member, a guide wall member integrally formed with said push button member and slidably inserted in said slide groove to movably support said operating portion on said housing, a guide column member formed at a center of said guide wall member to be movably inserted into said guide chamber, and a guide hole formed on said guide wall member;

a sleeve fitted into said guide wall member and having an engaging projection movably engaged with said guide hole;

a fixed contact fixedly supported on said housing;

a movable contact fixedly mounted on said sleeve facing said fixed contact;

a contact release spring located between said push button member and said column member and in said guide wall member for urging said operating portion away from said housing;

a contact connect spring located between said sleeve and said column member for urging said sleeve towards said fixed contact to thereby urge said movable contact towards said fixed contact;

operation control means comprising a combination of a cam and a pin, said cam being formed at an outer periphery of said guide wall member and including a concave engaging portion, said pin being fixed on said housing and engaged with said cam, said pin being engaged with said engaging portion of said cam to maintain said ON state when said operating portion is pushed down for switching from said OFF state where said movable contact and said fixed contact are out of contact with each other into said ON state where said operating portion is inserted into said housing by a predetermined distance to connect said movable contact and said fixed contact with each other, said pin being released from engagement with said engaging portion to return said operating portion into an initial position in said OFF state when said operating portion is further pushed down in said ON state.

3. A push button switch as claimed in claim 2, wherein each of said contact release spring and said contact connect spring comprises a compression coil spring, said contact release spring and said contact connect spring being arranged in cascade and coaxially aligned with said movable contact.

4. A push button switch as claimed in claim 2, wherein said guide chamber of said housing accommodates said contact release spring, said contact connect spring, said guide wall member, and said sleeve.

5. A push button switch as claimed in claim 2, wherein said guide column member encloses a guide cylinder member.

6. A push button switch as claimed in claim 1, wherein said contact connect spring, said contact release spring, and said coupling arrangement are located between said operating portion and said housing.

7. A push button switch as claimed in claim 1, wherein said movable contact is surrounded by a skirt portion fixed to said sleeve.

* * * * *